US005617918A

United States Patent [19]

Cooksey et al.

[11] Patent Number: 5,617,918

[45] **Date of Patent: *Apr. 8, 1997**

[54] WELLBORE LOCK SYSTEM AND METHOD OF USE

[75] Inventors: Andrew Cooksey, Coppell; Jim Williamson, Carrollton; Clark Robinson, Plano, all of Tex.; Chris Dines, London, England; James Vick, Dallas, Tex.

[73] Assignee: Halliburton Company, Dallas, Tex.

[ * ] Notice: The term of this patent shall not extend beyond the expiration date of Pat. No. 5,348,087.

[21] Appl. No.: 41,793

[22] Filed: Apr. 1, 1993

Related U.S. Application Data

[63] Continuation-in-part of Ser. No. 933,668, Aug. 25, 1992, Pat. No. 5,348,087.

[51] Int. Cl.[6] ..... E21B 23/00

[52] U.S. Cl. ..... 166/115; 166/217; 166/237

[58] Field of Search ..... 166/115, 217, 166/237, 123, 134, 214, 242, 322

[56] References Cited

U.S. PATENT DOCUMENTS

| | | | |
|---|---|---|---|
| 3,250,331 | 5/1966 | Boyle | 166/133 |
| 3,378,077 | 4/1968 | Elliston | 166/115 |
| 3,436,084 | 4/1969 | Courter | 277/116.2 |
| 4,116,277 | 9/1978 | McGee et al. | 166/315 |
| 4,284,137 | 8/1981 | Taylor | 166/137 |
| 4,288,082 | 9/1981 | Setterberg, Jr. | 277/125 |
| 4,349,204 | 9/1982 | Malone | 277/34 |
| 4,524,830 | 6/1985 | Williams | 166/322 X |
| 4,605,070 | 8/1986 | Morris | 166/322 X |
| 4,729,433 | 3/1988 | Jacob | 166/322 |
| 4,834,183 | 5/1989 | Vinzant et al. | 166/332 |
| 4,836,287 | 6/1989 | Couste et al. | 166/322 X |
| 5,119,875 | 6/1992 | Richard | 166/212 |
| 5,348,087 | 9/1994 | Williamson, Jr. | 166/115 |

FOREIGN PATENT DOCUMENTS

| | | | |
|---|---|---|---|
| 2266908 | 11/1993 | United Kingdom | E21B 33/12 |

*Primary Examiner*—Hoang C. Dang
*Attorney, Agent, or Firm*—William M. Imwalle; Michael L. Lynch

[57] ABSTRACT

A lock assembly includes radially movable engagement or latch members configured to engage a profile within a subsurface nipple, and further includes one or more sealing assemblies. The sealing assemblies are radially expandable by enlarging the interior of diameter of the elements of the sealing assembly, such as by placing a mandrel of relatively enlarged diameter through an internal diameter of elements of the sealing assembly.

11 Claims, 9 Drawing Sheets

WELLBORE LOCK SYSTEM AND METHOD OF USE

This is a continuation-in-part application under 35 U.S.C. § 120 of application Ser. No. 933,668 filed Aug. 25, 1992, now U.S. Pat. No. 5,348,087.

BACKGROUND OF THE INVENTION

The present invention relates generally to wellbore lock systems and to methods and apparatus for their use in tubular members disposed within a wellbore; and more particularly relates to such wellbore lock systems of a design particularly useful in relatively large or "full bore" applications.

Many types of locks are known for use in engaging tubular members within a wellbore, and for facilitating flow control operations or the placement of other equipment in the wellbore. Of particular interest are wellbore locks which can engage a relatively large, or "full bore", nipple within a string of casing or other tubular member (such as tubing, drill string, work string, etc.). A current trend in the drilling of wells is that of "slim hole drilling", which entails the drilling of the smallest diameter hole which is feasible. The subsequent performing of operations in such an operation requires that any restrictions in the casing, such as seal bores, nipples, etc., be minimal, and that the largest possible bore be maintained through the tubular string.

Typically, locks are run into the wellbore on either wireline or slickline. To facilitate this running-in process, it is desirable that the lock configuration provide minimal drag against the tubular string as the lock is inserted within the string. It is also desirable that the lock be capable of being set relatively simply, and therefore relatively inexpensively.

Conventional locks suitable for full bore applications, however, have included engagement members (commonly known as "latching dogs"), which will locate recesses within a profile or nipple by riding, or "dragging" against the interior of the tubular string as the lock is placed in the wellbore, and thereby engaging the recesses as the latching dogs pass through the profile. Additionally, such conventional locks typically include stationary sealing elements, such as conventional chevron-type seals, which will sealingly engage the profile. However, locks with such a sealing arrangement inherently require a reduced diameter section within the profile to facilitate establishing a sealing engagement with the lock, and thereby present an undesirable flow restriction within the tubular string.

Accordingly, the present invention provides a new lock system and method of its use which includes a lock which includes selectively radially extendable engagement members, and radially expandable sealing elements, thereby facilitating optimal use of the lock in full bore environments.

SUMMARY OF THE INVENTION

The present invention contemplates a novel lock assembly which includes a housing assembly and an actuation assembly. The actuation assembly is operatively associated with the housing assembly and movable in relation thereto. In a particularly preferred embodiment, the actuation assembly will be, at least in part, longitudinally movable relative to the housing assembly, and will extend at least partially therein. The lock includes at least one engagement member operatively coupled to the housing assembly which is movable from a first position, which is relatively radially retracted relative to the housing, to a second position, where the engagement member is relatively radially extended relative to the housing assembly. In a preferred embodiment, the first position facilitates the movement of the lock assembly through a tubular string while minimizing dragging against the interior sidewalls of the string, while the second, relatively radially extended, position allows the lock to selectively mechanically engage a profile within the tubular string to facilitate mechanically securing the lock in position.

The lock assembly also includes a sealing assembly which includes a seal element which is operated by expanding the internal diameter of the seal element, resulting in expansion of the external diameter. In one preferred embodiment, expansion will be accomplished through use of an actuation sleeve which includes a first section having a first diameter, and a second position having a second, larger diameter. In this preferred implementation, in an unactuated position, the first, relatively smaller, diameter of the actuation sleeve will radially underlie the seal element, and allow the seal element to remain in a relatively relaxed, and therefore unexpanded, state. The actuation sleeve may then be moved to a second position, wherein the second, relatively larger, section will underlie the seal; element, with the second section being cooperatively sized and configured to cause expansion of the internal diameter of the seal element, thereby urging the outer surface of the seal element into engagement with a profile. In one particularly preferred embodiment, the lock will include a sealing assembly which includes not only at least one expandable seal element, but also may involve one or more expandable backup member generally adjacent to the seal element and formed of a material adequate to prevent undesirable extrusion of the seal element. This backup material may also be incorporated into this seal element as a one piece sub assembly.

The invention further contemplates the use of a lock assembly having more than one seal elements in longitudinally spaced relation to one another, and adapted to engage a nipple having a control line inlet therein. The spaced seal elements preferably lie on opposed sides of the port, and thereby facilitate fluid communication between a control line and the interior of the lock assembly. In a further preferred implementation of this embodiment, the lock will be coupled to a surface controlled, flow control device, such as, for example, a subsurface safety valve, thereby facilitating control of the flow control device through lock 10.

Figure 6A:
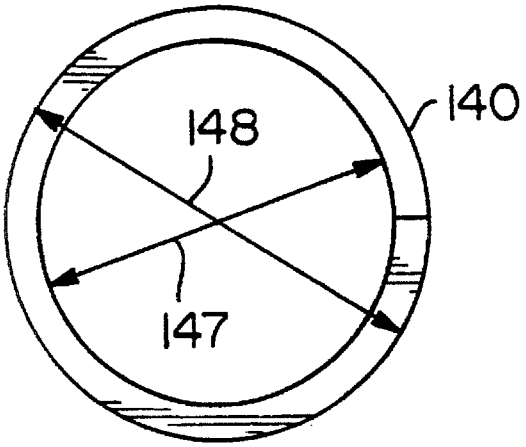
FIGS. 6A–D depict an alternative embodiment of backup ring suitable for use with the present invention depicted in FIGS. 6A and B in an expanded state in views rotated 90° from one another; and depicted in FIGS. 6C and D in a collapsed state in views rotated 90° relative to one another.
Figure 6B:
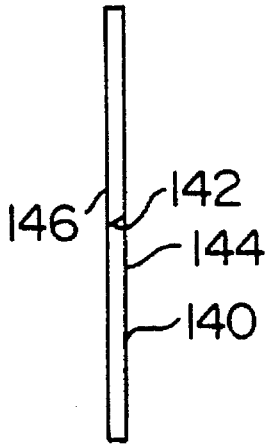
Figure 6C:
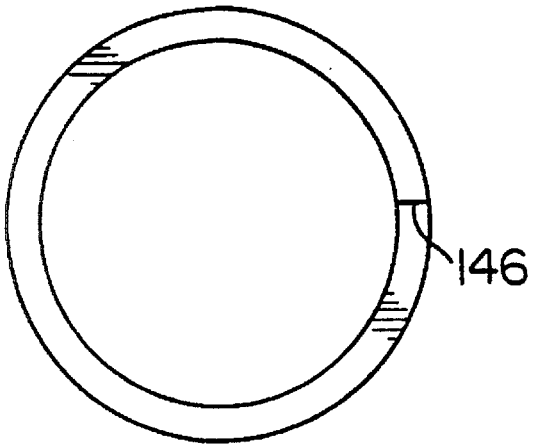
Figure 6D:
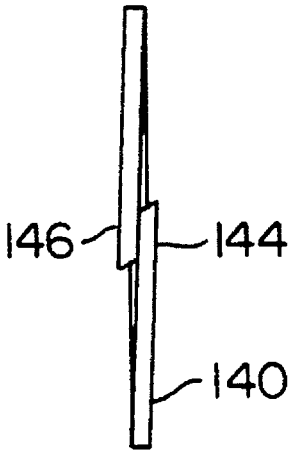
Figure 7A:
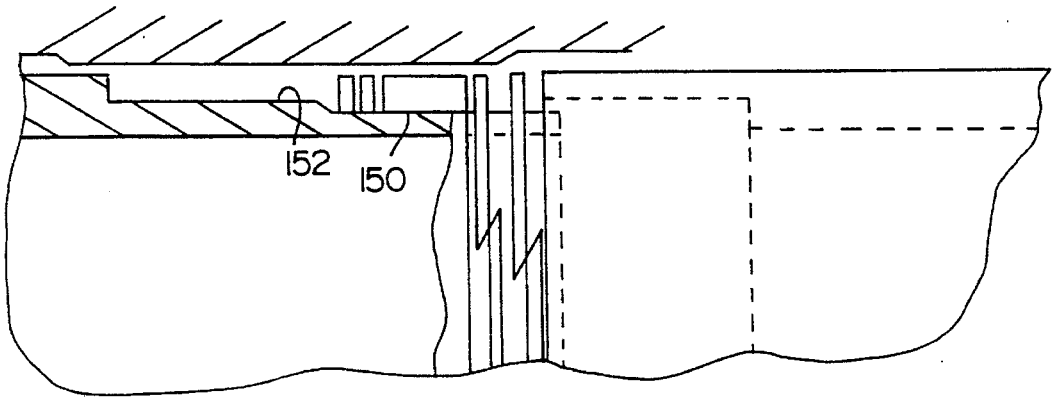
Figure 7B:
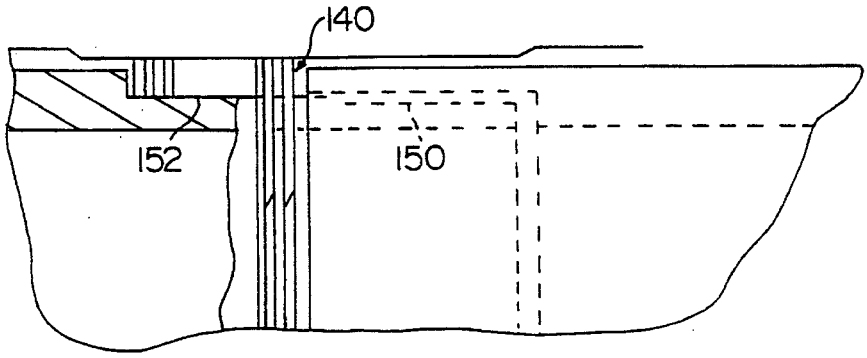

FIGS. 7A–B depict the backup ring of FIG. 6 installed in an operational relation on a lock; depicted in FIG. 7A in an unexpanded state; and depicted in FIG. 7B in an expanded state.

FIGS. 8A–D depict an alternative embodiment of a lock in accordance with the present invention, depicted in a combination with a subsurface safety valve forming an equipment string in accordance with the present invention.

Figure 9A:
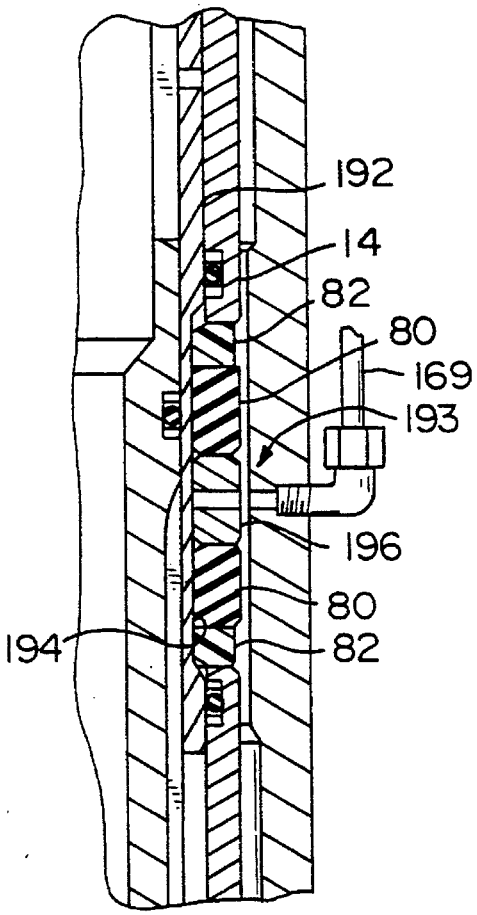
Figure 9B:
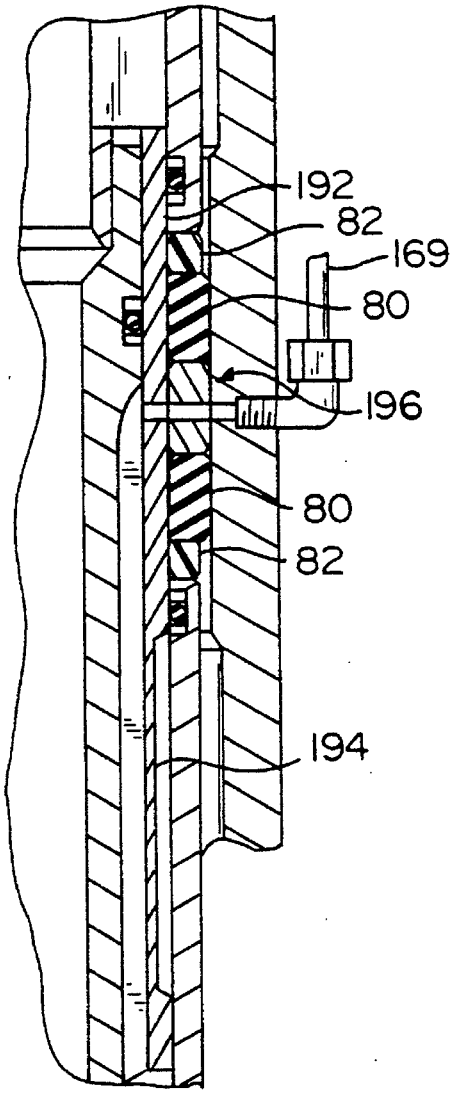

FIGS. 9A–B depict an alternative embodiment of a dual sealing arrangement in accordance with the present invention depicted in FIG. 9A in a relaxed condition, and in FIG. 9B in an expanded condition.

DETAILED DESCRIPTION OF PREFERRED EMBODIMENTS

Figure 1A:
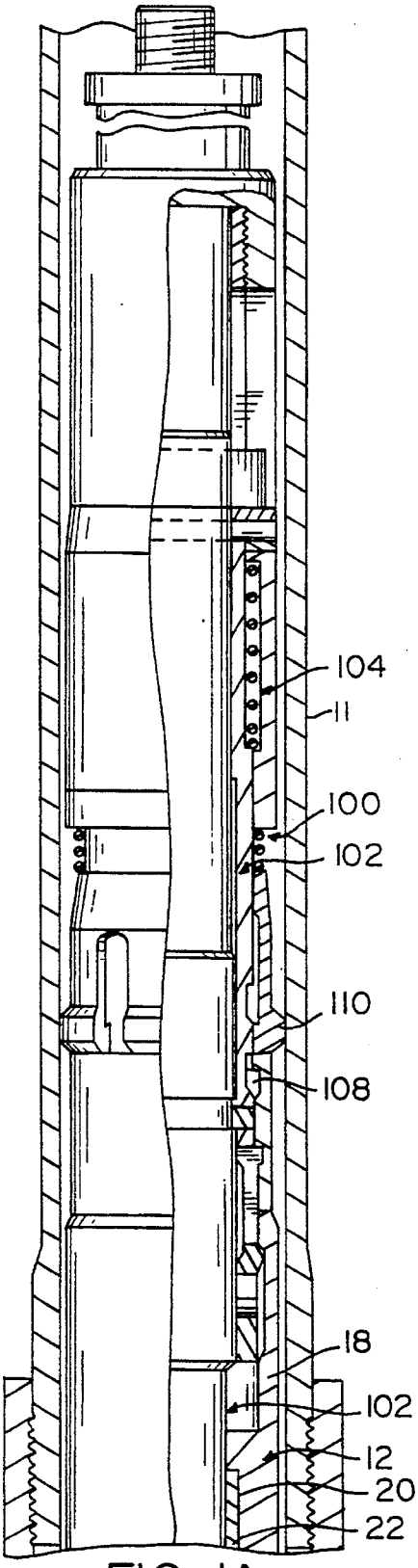
FIGS. 1A–B depict an exemplary lock in accordance with the present invention, illustrated in an operative attachment to an exemplary running tool, and disposed within a tubular string including a nipple.

Referring now to the drawings in more detail, and particularly to FIG. 1, there is depicted an exemplary lock assembly, indicated generally at 10, in accordance with the present invention. Lock 10 is depicted coupled to an exemplary running tool 100 in an exemplary operating application. Lock 10 and running tool 100 are depicted within a casing string 11 including a nipple 120.

Lock 10 includes a mandrel assembly, indicated generally at 12, a housing 14, and a lower sub 16. Mandrel assembly 12 includes a coupling sub 18 which is threadably coupled at 20 to an internal mandrel 22. Mandrel assembly 12 extends generally coaxially with, and partially within, housing 14.

Referring now also to FIGS. 2, 3, 4, and 5, the plurality of engagement members, such as latching members (or "dogs") 24 are each retained at least partially within a respective aperture 25 in housing 14. Each latch member 24 is retained in an operative relation relative to the remainder of lock 10 by an actuation spring 26 and actuation sleeve 28. Actuation sleeve 28 extends generally concentrically relative to internal mandrel 22, and in slidable relation thereto. Actuation sleeve 28 includes a first portion of a first diameter 29 and a second portion of a second larger diameter 31. A shoulder 33 is formed at the transition between the first and second portions. Actuation sleeve 28 further includes a plurality of longitudinal grooves 35, each in registry with a respective latch member 24, with each groove 35 having a bottom surface configured to form a radially extending detente portion 30 proximate its lower end. Actuation sleeve 28 further includes a generally annular recess 32 which is engageable with an external locating shoulder 34 formed on internal mandrel 22.

Each actuation spring 26 includes a retaining tab 36 which engages a recess 38 in housing 14. Each actuation spring 26 then includes a central "dog leg" portion, indicated generally at 40, including two bends 42 and 44, forming an actuation surface shoulder 46. Each actuation spring 26 terminates in an extension 48 which extends into a central aperture 50 of each latch member 24, and which is engageable with a generally radially inward tab 52 and a relatively radially outward shoulder 33. The interaction of extension 48 with tab 52 and shoulder 54 allows actuation spring 26 to selectively urge latch member 24 radially outwardly, as will be described later herein, and also to retain latch member 24 in an operative relation relative to housing 14.

An inner sleeve 54 is threadably coupled at 56 to housing 14. Inner sleeve 54 has a generally upwardly extending annular portion 58 which includes a longitudinal groove 60 therein. A generally lower portion 62 of inner sleeve 54 defines a portion of the internal bore through lock 10. Lower sub 16 is threadably coupled at 64 to inner sleeve 54, and includes an upwardly extending annular portion 66 which cooperates with housing 14 to define a sealing assembly retention recess, indicated generally at 68. Housing 14, inner sleeve 54, and lower sub 16 also cooperatively define an annular chamber 70. A packing element actuation sleeve 72 is slidably retained within chamber 70. Packing element actuation sleeve 72 includes a longitudinal recess 77 which engages an actuation lug 76 coupled to inner mandrel 22, and extending through longitudinal groove 60 in upper portion 58 of inner sleeve 62.

Packing element retention recess 68 is an annular gap, which facilitates the placement of a packing assembly, indicated generally at 78, around packer element actuation sleeve 72. In one preferred embodiment, packing element assembly 78 will include a generally annular elastomeric seal element 80, with a solid, but radially expandable backup ring 82 on each side of elastomeric seal element 80 in recess 68. In one preferred embodiment, elastomeric seal element 80 will be a nitrile element, of approximately 80–90 durometer. Also in one preferred embodiment, each backup ring 82 will be a solid, but expandable, element, such as may be formed of untilled virgin polyetheretherketone ("PEEK"). For example, the material sold under the trade name of "Arlon 1000" by Greene, Tweed Engineered Plastics of Hatfield, Pa., has been found satisfactory for this purpose.

Packing element actuation sleeve 72 includes an annular recess 74 which, in a first, unactuated, position will underlie the elements of packing element assembly 78. Also in such first position, a seal surface 86 will underlie and sealingly engage a conventional O-ring seal **88*a* on annular extension 66 of lower sub 16. Similarly, a conventional O-ring seal 88*b* will sealingly engage the external surface of packing element actuation sleeve 72. Lock 10 will be designed to be placed within casing (or another tubular member), having an internal diameter of 2.992 inches. In such application, a profile 122 will preferably have a seal surface diameter of 2.875 inches (the landing nipple inside diameter seal bore). In this embodiment, housing 14 of lock 10 will preferably have an external diameter of approximately 2.83 inches. In this same preferred embodiment, backup rings 82 will each have a nominal internal nonexpanded diameter of approximately 2.310 inches and a nominal external diameter of approximately 2.790. Elastomeric seal element 80 will preferably have a nominal internal diameter of approximately 2.250, and a nominal external diameter of approximately 2.810. Annular recess 84, preferably has a diameter of approximately 2.265 inch, or 0.117 inch smaller than the outer diameter of the remainder of packing element actuation sleeve 72**.

As previously discussed, lock 10 is depicted coupled to an exemplary running tool 100 of a type suitable for use in placing lock 10 within a well. Running tool 100 will preferably be of a conventional design such as the model R running tool manufactured by OTIS Engineering Corporation of Dallas, Tex. The use of the model R running tool is familiar to those skilled in the art. Accordingly, the structure and operation of running tool 100 will be described here only briefly.

Running tool 100 includes a central mandrel assembly 102 telescopingly retained relative to a housing 104. Central mandrel assembly 102 is coupled through a shear pin 106, to inner sleeve 54 of lock 10. Running tool 100 also includes a plurality of nipple locating members 110 which will engage a lower shoulder of a nipple, but will retract into recesses 108 of mandrel assembly 102 upon relative movement of central mandrel assembly 102 relative to housing assembly 104.

Figure 1B:
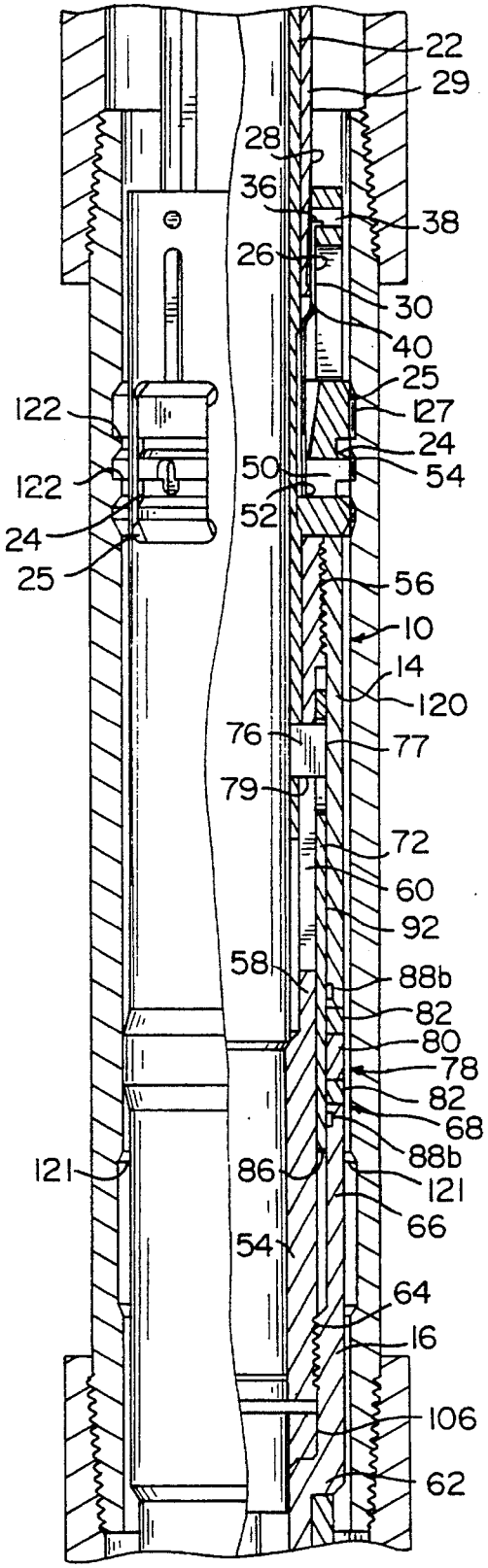

As can be seen in FIG. 1B, when lock 10 is in the running-in position, coupling sub 18 and attached internal mandrel 22 are in a relatively extended position relative to housing 14. In this position, by virtue of the engagement of radially extending shoulder 34 of internal mandrel 22 with annular recess 32 of actuation sleeve 28, detent portion 30 of actuation sleeve 28 is above dogleg portion 40 of actuation spring 26, thereby urging extension 48 of actuation spring 26 generally radially inwardly. Extension 48 contacts tab 52 of latch member 24 and maintains latch member 24 relatively retracted relative to housing 14; preferably retracted at least substantially within the outer diameter of housing 14.

Figure 2B:
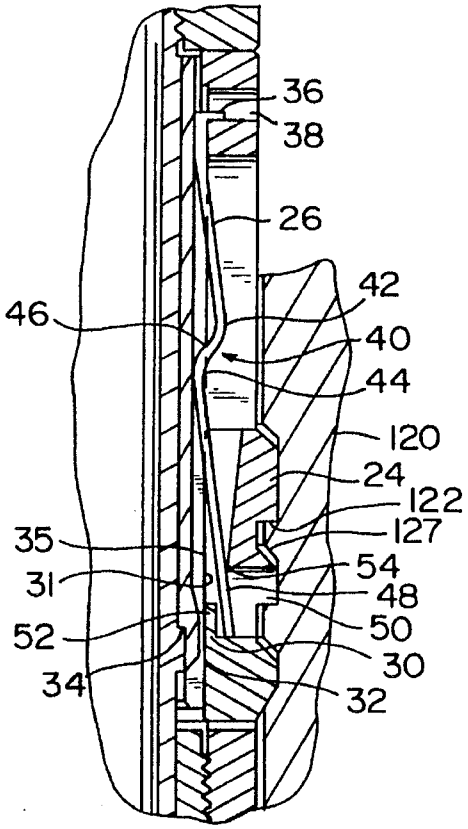
FIGS. 2A–B depict the latch member actuation portion in varying stages of actuation; depicted in FIG. 2A with latch members 24 in a "locating" position; and depicted in FIG. 2B in a locked position.
Figure 2A:
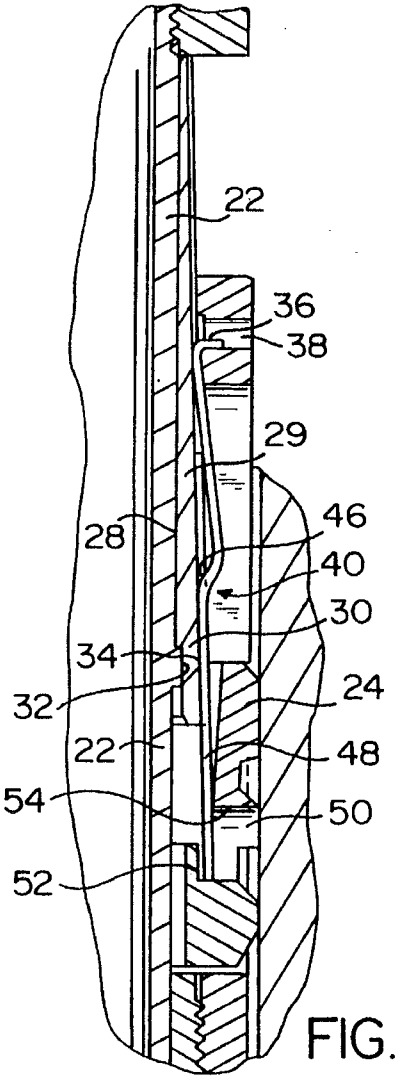
Figure 3A:
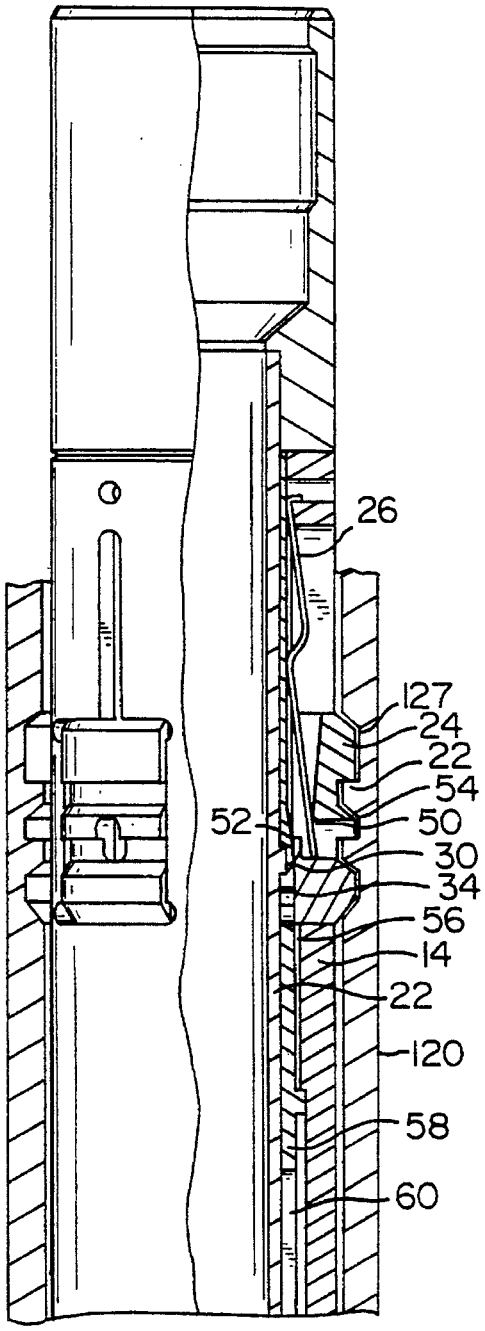
FIGS. 3A–B depict the lock of FIG. 1 in an actuated position.
Figure 3B:
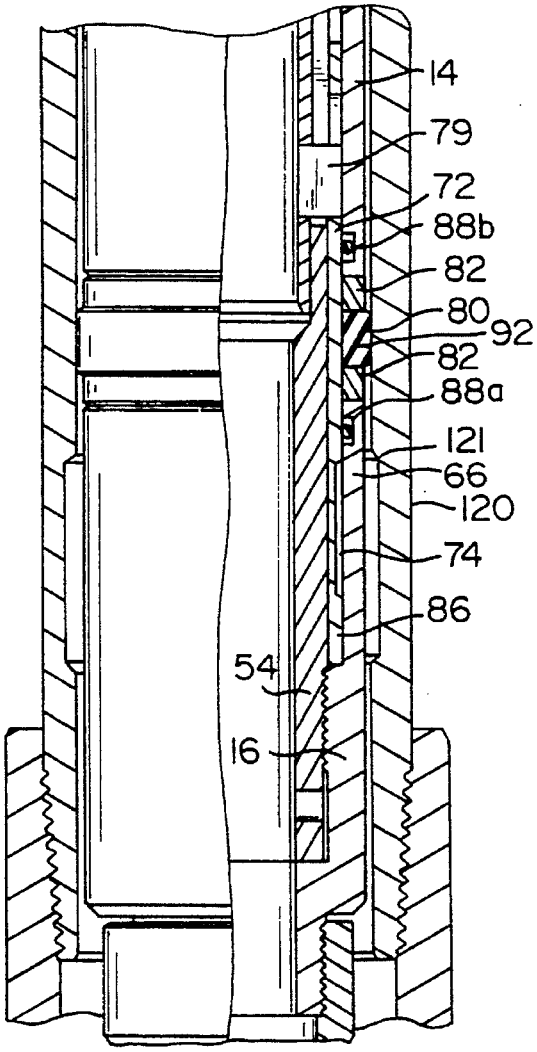
Figure 5:
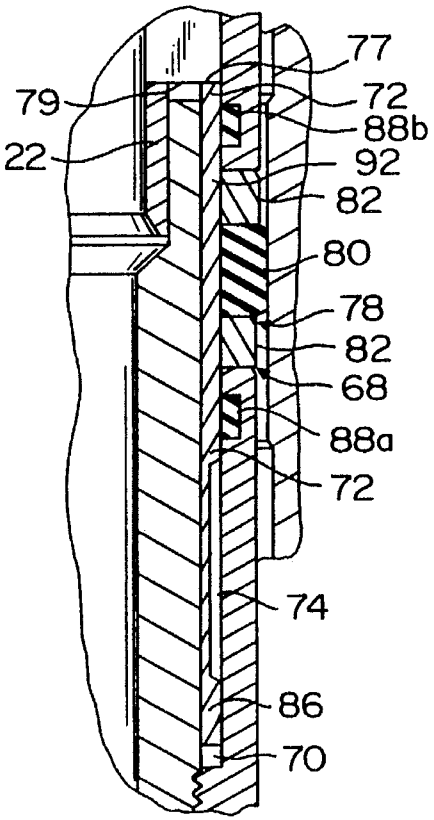
FIG. 5 depicts the sealing assembly of the lock of FIG. 1 in greater detail, and in an actuated position, illustrated partially in vertical section.

As running tool 100 runs up through the tubular string, and through nipple 120 installed therein, nipple locator members 110 will engage a locating shoulder 121 of nipple 120. Further upward movement applied through the running tool 100, through central mandrel 102, will act through shear pin 106 to exert a generally upward pull on lower sub 16, inner sleeve 62 and housing 14. Thus, these components, as well as packing element actuation sleeve 72, actuation spring 26 and latch members 24 will move upwardly relative to inner mandrel 22 and particularly relative to detente portion 30 of actuation sleeve 28. This movement will preferably be relatively short, on the order of 0.375 inch. This movement biases extension 48 of actuation spring 26 relatively outwardly, thereby biasing latch members 24 to a radially outward, but spring biased, position, as depicted in FIGS. 2B and 3A–B. After such predetermined movement of running tool mandrel assembly 102 relative to running tool housing 104 and associated nipple locator members 110, nipple locator members will retract into recesses 108 in mandrel assembly 102 and facilitate movement of running tool 100 and lock 10 upwardly through nipple 120.

Accordingly, as upward movement is applied through running tool 100, latch members 24 of lock 10 will retract to enter nipple 120, but are spring biased outwardly, and will extend to engage complimentary recesses 127 formed in nipple profile 122. Latch members 24 and nipple profile 122 preferably have complimentary tapered surfaces 124 which facilitate upward movement of latch members 24 through nipple profile 122, but which resist downward movement. In this preferred embodiment, nipple profile 122 includes two longitudinally spaced shoulders which extend generally perpendicularly relative to the longitudinal axis of nipple profile 122. Once lock 10 is engaged with nipple profile 122, downward jarring applied through running tool 100 facilitates relative compression of lower sub 16, inner sleeve 62 and housing 14 relative to inner mandrel 22. As mandrel assembly 12 moves downwardly, relative to housing 14 and the associated elements, detente portion 30 of actuation sleeve 28 comes to rest behind tab 52 in the lower proximate body portion of each latch member 24 (or depicted in FIG. 2B), thereby preventing retraction of latch member 24 relative to housing 14, and thereby establishing a positive mechanical engagement of lock 10 with nipple profile 122.

Simultaneously with such motion, relatively downward movement of inner mandrel 22, and associated actuation lug 76, causes lower surface 79 of lug 76 to engage an upper shoulder 77 of packing element actuation sleeve 72 to move it downwardly relative to inner sleeve 62 and lower sub 16. This downward movement causes reduced diameter recess 74 to be moved longitudinally beneath lower seal 88*a*, and causes relatively enlarged diameter portion 92 of packer element actuation sleeve 72 to be brought into registry with packing element assembly 78. This positioning causes expansion of the internal diameter of each backup ring 82 and of elastomeric seal element 80, thereby further resulting in expansion of the outer diameter of each component. This expansion facilitates establishing of a sealing engagement between elastomeric seal element 80 and nipple 120, with backup rings 82 being similarly expanded to avoid extrusion of elastomeric seal element 80. The movement of packing element actuation sleeve 72 concentrically to inner sleeve 54 facilitates inner sleeve 54 providing structural support for actuation sleeve 72 as it serves to expand packing element assembly 78. This support facilitates actuation sleeve 72 being formed as a relatively thin annular component.

Referring now to FIGS. 6A–D and 7A–B, therein is depicted an alternative embodiment of backup ring 140 in accordance with the present invention. Backup ring 140 may be utilized in place of either or both of backup rings 82, formed of PEEK, as described earlier herein. Backup ring 140 is a solid ring having a circumferentially tapered (or "scarf") cut 142 therein. Backup ring 140 is formed such that in an unexpanded condition, as depicted in FIGS. 6C–D, relative ends 144 and 146 on either side of tapered cut 142 will overlap, thereby establishing a reduced diameter state of backup ring 140. Tapered cut 142 is oriented to facilitate ends 144 and 146 moving toward an adjacent, overlapping, relation when ring 140 is not subjected to an expanding force. Backup ring 140 is also formed such that when in an expanded condition, both the internal and external diameters, 147 and 148, respectively are, or closely approximate, perfect circular shapes. Such conformity assures that in an operating environment, backup ring 140 will establish a uniform backup surface for an associated elastomeric seal (element 80 in FIG. 1).

As depicted in FIGS. 7A–B in an exemplary configuration, a reduced diameter portion 150 of an actuation sleeve 152 allows ends 144 and 146 to overlap. Expansion of backup ring 140 around a larger diameter section 152 causes backup ring 140 to assume a planar, circular, shape.

The present invention also contemplates a method of constructing backup ring 140. For purposes of description herein, an exemplary backup ring will be described which is constructed to have a final outer diameter in a relaxed state of approximately 2.80 inches, and an outer diameter in an expanded state of approximately 2.865 inches. Ring 140 in this embodiment will have an internal diameter in an expanded state of approximately 2.379 inch, and a thickness of approximately 0.010 inch. Backup ring 140 may be formed of any appropriate material having a suitably low modulus of elasticity. In particularly preferred embodiment, backup ring 140 will be formed of titanium, because of both its relatively low modulus of elasticity, and its suitability for use in hydrogen sulfide ($H_2S$) environments.

Preferably, ring 140 will be machined with a slightly oversized outer diameter and a slightly undersized internal diameter. Once machine is a solid ring, tapered cut 142 will be made into solid ring, typically removing approximately 0.032 inch of material. Subsequently, the ring will be generally uniformly compressed such that the external diameter decreases. This compression will induce permanent deformation in the ring. Subsequently, the ring may be expanded to where relative ends 144 and 146 are engaged, and ring 40 forms a continuous annular member. The outer diameters and interior diameters will then preferably be machined to finish diameters.

Referring now to FIG. 8A–D, therein is depicted an alternative embodiment of a lock and full bore nipple in accordance with the present invention, and incorporated in a system with a surface controlled subsurface safety valve, in an exemplary configuration also in accordance with the present invention. As is well known to those skilled in the art, the use of surface controlled subsurface safety valves, which are operated through use of a hydraulic control line extending to the surface has long presented a problem to the use of full bore nipples. The complexity of providing a hydraulic fluid passage from the surface, into the tubular member and subsequently to the safety valve has required relatively restricted nipple configurations. FIGS. 8A–D depict a full bore nipple and lock design, indicated generally at 160, in combination with a subsurface safety valve, indicated generally at 162.

Figure 4:
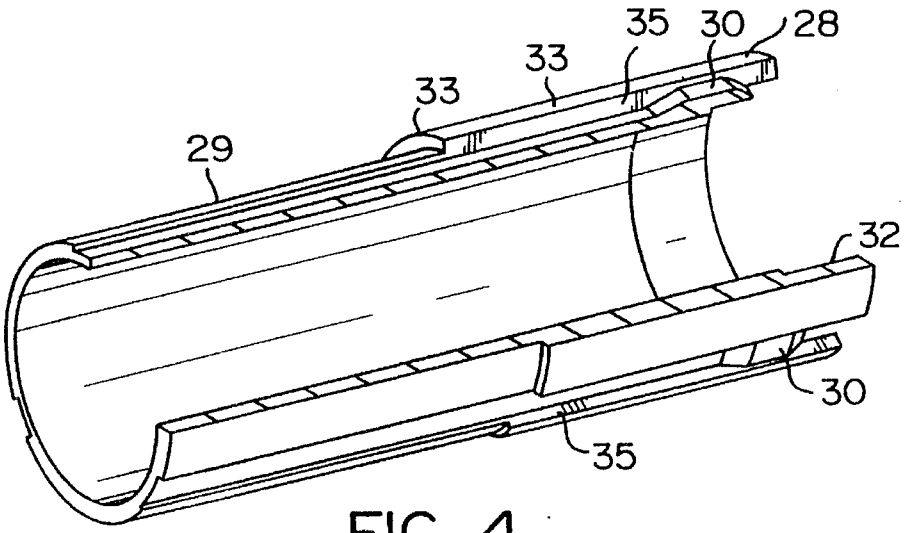
FIG. 4 depicts the latch member actuation sleeve of the lock of FIG. 1 in greater detail, illustrated partially in oblique section.

Nipple 163 includes a seal bore 165 and a recessed profile 167. Seal bore 165 is in fluid communication with a control fluid passage 167, which is coupled in a conventional matter to a control line 169. Fluid to control the subsurface safety valve will be applied through control line 169 in a manner known to those skilled in the art. Lock assembly 164 operates in a manner similar to that described relative to lock 10. The portion of lock 164 above actuation lug 76 is preferably essentially identical to that as described relative to lock 10. Elements of lock 164 which are essentially identical to those described relative to lock 10 have been numbered similarly, and elements which are functionally similar though possibly of a slightly different configuration have been indicated with primes. As can be seen in FIG. 4, lock assembly does not include a lower sub 16, but includes a coupling sub 166 which facilitates coupling of lock 164 to subsurface safety valve assembly 162. Coupling sub 166, housing 14, and inner sleeve 62' cooperatively define an annular passage 70' within which packing element actuation sleeve 172 may move. Coupling sub 166 and housing 14 cooperatively define a packing element retention recess 68' housing packing element assembly 168. Packing element assembly 168 includes two seal assemblies 78*a*, 78*b*, each of which may be essentially identical to seal assembly 78 of lock 10. Seal assemblies 78*a*, 78*b* are separated tin spaced relation by a ported spacer ring 170, including, preferably, a plurality of ports 172 therethrough. Preferably, ported spacer ring will be formed of virgin PEEK, as are backup rings 162.

Figure 8A:
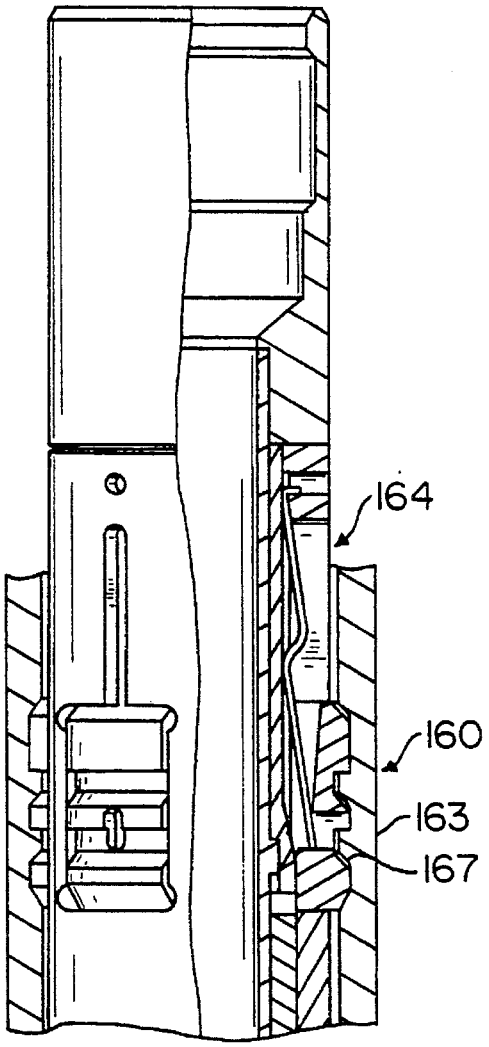
Figure 8B:
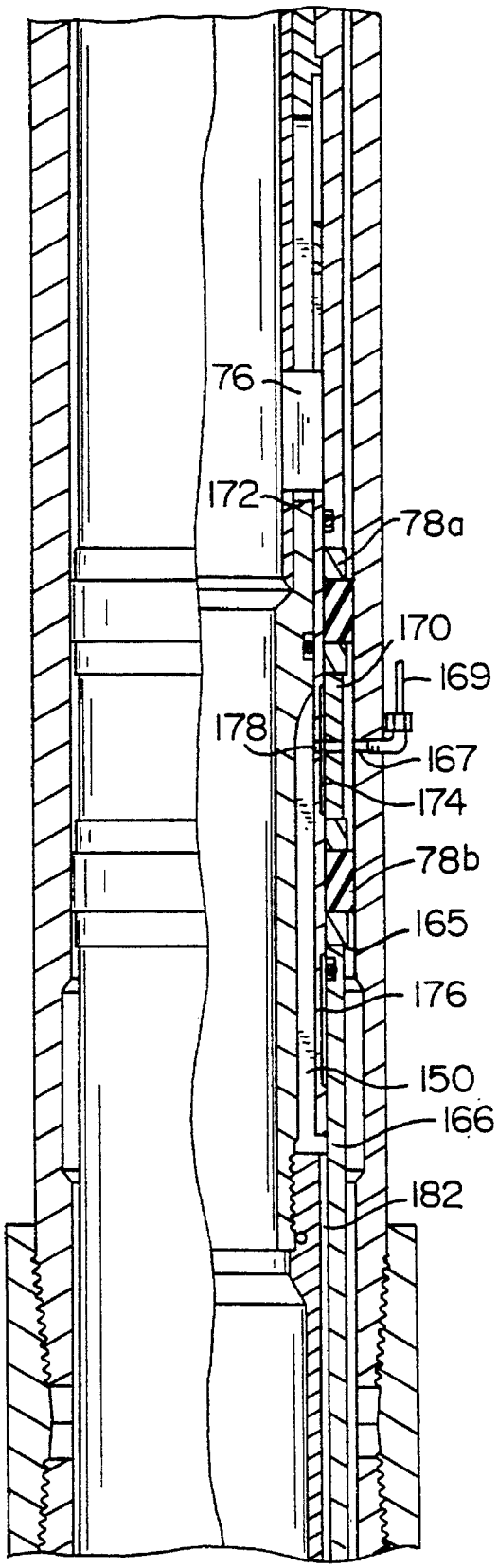
Figure 8C:
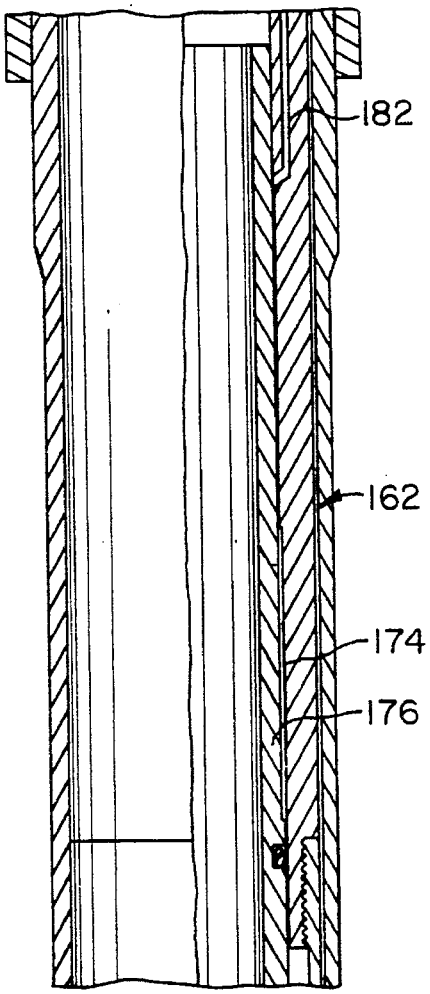
Figure 8D:
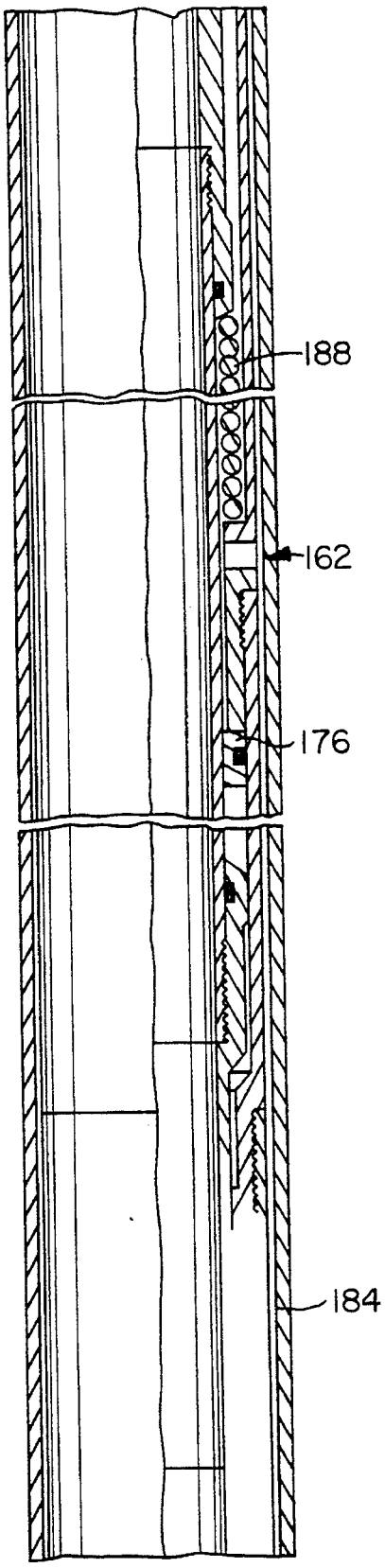

As can be seen in FIG. 8B, packer actuation sleeve 72' includes two recesses 174, 176 which will underlie a respective seal assembly 78*a*, 78*b* when lock 164 is in an unactuated position, but which will be longitudinally offset from the respective seal assembly 78*a*, 78*b*, when lock 164 is set within nipple 163, as depicted in FIGS. 8A–D.

As can be seen in FIG. 8B, packing element actuation sleeve 72' includes a port 178 proximate recess 174. When packing element actuation sleeve 72' has been moved to an actuated position, wherein sleeve operates to expand the internal diameters of seal assembly 78*a*, 78*b*, port 172 provides fluid communication between control line 169 and control fluid passage 167' to an internal chamber 180. Coupling sub 166 preferably includes at least one fluid passage 182 which is in fluid communication with chamber 180.

When lock 164 is placed in the locked position, through manipulation functionally identical to that described relative to lock 10, packing element actuation sleeve 72' will move downwardly in passage 70', thereby expanding the internal diameters, and therefore the external diameters, of each backup ring 82, and elastomeric seal elements 80 and 80 of seal assemblies 78*a*, 78*b*. Ported spacer ring 170 is preferably formed with an internal diameter larger than the outer diameter of sleeve 178. Sealing engagement of elastomeric seal elements 80 with internal surface 174 of nipple 161 establishes a fluid flow path from port 176 in nipple 161, through passage 70' to fluid passage 182 in coupling sub 166. This fluid passage then communicates with pressure chamber 174 in subsurface safety valve 162 to facilitate selective operation of piston sleeve 176 to operate safety valve 162 in a conventional manner. Briefly, so long as fluid pressure is applied through central line 169 to pressure chamber 174, piston sleeve 176 is maintained in a relatively downward position where it retains flapper valve 184 in an open position, as depicted in FIG. 8B. If fluid pressure is not applied to maintain piston sleeve 176 in this position, return spring 188 will urge piston sleeve 176 upwardly, allowing flapper valve 184 to close.

Subsurface safety valve 162 as depicted herein may be substantially a Series 10 surface controlled subsurface safety valve, as manufactured by Otis Engineering Corporation of Dallas, Tex. The operation of such subsurface safety valves is well known in the art. The specification of U.S. Pat. No. 4,834,183, issued May 30, 1989, to Michael B. Vizant, Craig D. Hines, Rennie L. Dickson, and Robert C. Hammett, and assigned to Otis Engineering is hereby incorporated herein by reference, as an exemplary description of the structure and operation of such a subsurface safety valve. It should be clearly understood that safety valve 162 is merely one of many types of safety valves or other surface controlled flow control devices known to the an and suitable for use in accordance with the present invention.

Referring now to FIG. 9A–B, therein is depicted an alternative sealing arrangement 190 for a lock establishing a flow path with a ported nipple. Sealing arrangement 190 is similar to that depicted relative to lock 164. However, sealing arrangement 190 has been modified to shorten the length of the sealing assembly, thereby facilitating the use of a packing element actuation sleeve 192 having a single recess 194. Sealing configuration 190 includes a packing element assembly 193 including a central ported backup ring 196, with an elastomeric seal element 80 on each side thereof, and with a backup ring 82 at each end. Ported backup ring 196 may be formed similarly to backup rings 82, with the exception that ported space of ring will preferably have an axial dimension of approximately 0.5 inch. Preferably, ported backup ring 196 will be formed of virgin PEEK, as are backup rings 82. The operation of sealing configuration 190 is similar to that previously described relative to lock 10 and lock assembly 164.

Many modifications and variations may be made in the techniques and structures described and illustrated herein without departing from the spirit and scope of the present invention. Accordingly, it should be readily understood that the embodiments described and illustrated herein are illustrative only, and are not to be considered as limitations upon the scope of the present invention.

What is claimed is:

1. A lock comprising:

a housing assembly;

an actuation assembly operatively associated with said housing assembly and movable in relation to said housing assembly;

at least one engagement member coupled to said housing assembly, said engagement member moveable from a first position wherein said engagement member is substantially radially retracted relative to said housing assembly, to a second position wherein said engagement member is operatively extended relative to said housing assembly;

a moveable sleeve assembly operably coupled to said engagement member, said movable sleeve assembly movable from a first position to a second position, wherein in said first position said movable sleeve urges said engagement member toward said first position, and wherein in said second position said movable sleeve assembly urges said engagement member toward said second position; and a sealing assembly coupled to said housing assembly, said sealing assembly comprising an expandable seal element and an expandable backup member, said seal element and backup member each having an interior surface, said seal element operatively associated with said actuation assembly to facilitate radial expansion of said interior surface of said seal element and said backup member upon predetermined movement of said actuation assembly.

2. The lock of claim 1, wherein said actuation assembly is longitudinally movable in relation to said housing assembly.

3. The lock of claim 1, wherein said at least one engagement member is movable from the first position wherein said engagement member is radially retracted substantially entirely within the outer diameter of said housing assembly, to the second position.

4. The lock of claim 1, further comprising a second expandable backup member coupled to said housing assembly proximate said expandable seal element, said expandable backup ring also operatively associated with said actuation assembly to facilitate radial expansion of both said backup members upon predetermined movement of said actuation assembly.

5. A lock, comprising:

a housing assembly;

an actuation assembly extending partially within said housing assembly and arranged for relative longitudinal movement in relation thereto, said actuation assembly including a seal element actuation sleeve having a first section of a first diameter and a second section of a second, larger, diameter, said actuation assembly also including an engagement member actuation sleeve and a spring operably associated therewith;

at least one engagement member, said engagement member movable between a first, relatively radially retracted, position, and a second, relatively radially extended, position relative to said housing in response to movement of said engagement member actuation sleeve and said spring;

a generally annular seal element operatively coupled to said housing, said seal element moveable from a first, relatively radially retracted, position to a second, relatively radially expanded, position, said sealing assembly cooperatively arranged relative to said seal element actuation sleeve such that said first section of said seal element actuation sleeve is radially adjacent said seal element when said seal element actuation sleeve is in said first position, and where predetermined movement of said seal element actuation sleeve relative to said housing moves said second section of said seal element actuation sleeve radially adjacent said seal element and causes radial expansion of the interior diameter of said seal element.

6. The lock of claim 5, wherein said lock further comprises at least one radially expandable backup ring.

7. The lock of claim 5, wherein said actuation assembly further comprises the engagement member actuation sleeve operatively coupled to said at least one engagement member to facilitate movement of said engagement member from said first position to said second position.

8. A lock assembly adapted to cooperatively engage and seal within a profile within a wellbore, comprising;

a housing assembly;

an actuation assembly operatively coupled to said housing assembly and movable in relation to said housing assembly between first and second positions;

an engagement assembly operating coupled to said actuation assembly, said engagement assembly including a plurality of engagement members retained in a generally retracted position relative to said housing assembly when said actuation assembly is in said first position, said plurality of engagement members urged to a generally extended position relative to said housing when said actuation assembly is in said second position;

a first seal assembly operatively coupled to said housing assembly, said second seal assembly including a second expandable seal element having an inside surface, and said first and second seal assemblies coupled to said housing assembly in longitudinally spaced relation to one another, and selectively engageable with said actuation assembly, with said actuation assembly engageable with said inside surfaces of said first and second seal elements, said inside surfaces of said first and second seal elements radially expandable in response to said movement of said actuation assembly relative to said housing assembly.

9. A flow control system for use in a subterranean wellbore in which a tubular string is disposed, said tubular string including a profile coupled to a control line fluid inlet, comprising:

a lock assembly, an actuation assembly operatively coupled to said housing assembly and movable in relation to said housing assembly, a first seal assembly operatively coupled to said housing assembly, said first seal assembly including a first expandable seal element having an inside surface, a second seal assembly operatively coupled to said housing assembly, said second seal assembly including a second expandable seal element having an inside surface, said first and second seal assemblies coupled to said housing assembly in longitudinally spaced relation to one another, and selectively engageable with said actuation assembly, with said actuation assembly engageable with said inside surfaces of said first and second seal elements, said inside surfaces of said first and second seal elements radially expandable in response to said movement of said actuation assembly relative to said housing assembly, wherein said first and second seal assemblies are spaced to engage said profile on opposite sides of said control line fluid inlet, said lock assembly defining a fluid passageway in fluid communication with said control line fluid inlet, and a subsurface flow control device including an actuation element movable in response to fluid pressure, said subsurface flow control device coupled to said lock assembly to establish fluid communication between said passageway in said lock assembly and said movable actuation element in said subsurface flow control device.

10. The flow control system of claim 9, wherein said lock assembly further comprises a plurality of engagement members operatively coupled to said housing assembly, said engagement members movable from a first position wherein said engagement members are substantially radially retracted relative to said housing assembly and facilitate traversal of said lock through said tubular member assembly, to a second position wherein said engagement members are operatively extended relative to said housing assembly to operatively engage said recesses and said profile.

11. The flow control system of claim 9, wherein said subsurface flow control device comprises a pressure control safety valve operable in response to movement of a piston, and wherein said piston is in fluid communication with said passageway in said lock assembly.

* * * * *